US007128249B2

(12) United States Patent
VanDerMeid et al.

(10) Patent No.: US 7,128,249 B2
(45) Date of Patent: Oct. 31, 2006

(54) INK CONTAINER OPENER

(75) Inventors: Michael J. VanDerMeid, Livonia, NY (US); Martin Finkle, Rochester, NY (US); Carl William Holland, Webster, NY (US)

(73) Assignee: Nu-Kote International, Inc., Franklin, TN (US)

( * ) Notice: Subject to any disclaimer, the term of this patent is extended or adjusted under 35 U.S.C. 154(b) by 25 days.

(21) Appl. No.: 10/786,976

(22) Filed: Feb. 25, 2004

(65) Prior Publication Data

US 2005/0183556 A1 Aug. 25, 2005

(51) Int. Cl.
*B67B 7/00* (2006.01)
*B26F 3/00* (2006.01)

(52) U.S. Cl. ..... 225/1; 225/93; 81/3.39

(58) Field of Classification Search ..... 225/93, 225/94, 95, 96, 96.5, 1; 141/18; 347/87; 81/3.39; 248/220.1, 124.1
See application file for complete search history.

(56) References Cited

U.S. PATENT DOCUMENTS

| | | | | |
|---|---|---|---|---|
| 1,376,994 | A | 5/1921 | Arnold | |
| 2,057,614 | A | 10/1936 | Girard | |
| 2,386,460 | A | 10/1945 | Heim | |
| 2,526,362 | A | 10/1950 | Johnston | |
| 2,554,948 | A | 5/1951 | Kiefer | |
| 2,818,701 | A | 1/1958 | Erkkila | |
| 2,876,665 | A | 3/1959 | Lecours | |
| 3,404,593 | A | 10/1968 | Arcarese et al. | |
| 3,828,976 | A | 8/1974 | Sidelinker | |
| 3,966,056 | A * | 6/1976 | Larson | 211/134 |
| 3,993,220 | A | 11/1976 | Troy | |
| 4,026,262 | A | 5/1977 | Yasuga | |
| 4,171,055 | A | 10/1979 | Lindgren | |
| 4,248,564 | A | 2/1981 | Gentile et al. | |
| 4,378,624 | A | 4/1983 | Klingenberg | |
| 4,633,740 | A | 1/1987 | Jacobs | |
| 4,690,359 | A * | 9/1987 | Phillips | 248/300 |
| 4,708,033 | A | 11/1987 | Eash | |
| 4,768,271 | A | 9/1988 | Jacob et al. | |
| 4,805,821 | A | 2/1989 | Kowalczyk et al. | |
| 4,817,810 | A | 4/1989 | Shull | |
| 5,031,485 | A | 7/1991 | Wu | |
| 5,129,566 | A | 7/1992 | Ogden et al. | |
| 5,199,470 | A | 4/1993 | Goldman | |
| 5,295,419 | A | 3/1994 | Denning | |
| 5,537,134 | A | 7/1996 | Baldwin et al. | |

(Continued)

FOREIGN PATENT DOCUMENTS

EP 0 816 100 A2 1/1998

(Continued)

OTHER PUBLICATIONS

Communication—European Search and Examination Report dated Jun. 7, 2005 with Abstract 05002114.6.

*Primary Examiner*—Charles Goodman
(74) *Attorney, Agent, or Firm*—Fay, Sharpe, Fagan, Minnich & McKee, LLP

(57) ABSTRACT

An ink container opener has a first portion and a second portion which are approximately perpendicular to each other. Each portion has an opening for receiving an ink container cap. The opening of the first portion comprises a plurality of ridges extending along at least one side of the opening. The first and second portions are formed of a unitary construction and form an L-shaped configuration. Force is applied to the container body to separate the cap from the body as the cap is supported by the opener.

22 Claims, 4 Drawing Sheets

U.S. PATENT DOCUMENTS

| | | | | |
|---|---|---|---|---|
| 5,546,830 | A | 8/1996 | Yuen | |
| 5,551,643 | A | 9/1996 | Chapin | |
| 5,657,678 | A | 8/1997 | Cohen | |
| 5,704,403 | A | 1/1998 | Schwenk et al. | |
| 5,838,352 | A | 11/1998 | Martinez | |
| 5,845,682 | A | 12/1998 | Hayao | |
| 5,906,143 | A | 5/1999 | Yuen | |
| 6,053,604 | A | 4/2000 | Sato et al. | |
| 6,116,724 | A | 9/2000 | Bursese | |
| D437,534 | S | 2/2001 | Gloden | |
| 6,568,642 | B1 * | 5/2003 | Kirschner | 248/65 |

FOREIGN PATENT DOCUMENTS

| | | |
|---|---|---|
| EP | 0 816 100 A3 | 1/1998 |
| WO | WO 97/47475 | 12/1997 |

* cited by examiner

INK CONTAINER OPENER

The invention relates to an ink container opener. More particularly, it relates to an ink container opener which is adapted to be used to remove caps from several types of ink containers, used in ink jet printing.

BACKGROUND OF THE INVENTION

An ink container typically includes a container body and a container cap. The cap is usually ultrasonically welded, glued or heat staked to the body after the container has been filled with ink during initial manufacturing. Once the ink has been depleted from the container, the container can be reused by refilling it with ink. Refilling ink cartridges with ink is a two step process. First, access must be provided such as by breaking open and removing the cap from the cartridge. Then, the reservoir must be refilled. To assist in refilling the ink container, the user usually drills holes through the cap to provide access into the interior of the container so that ink can be added. At times the ink container cap may be fabricated of a rigid plastic material that is difficult to penetrate using a hand-held drill bit which is typically supplied with ink refill kits. Thus, drilling holes into the cap can be difficult for the user, especially for a color ink container where three holes are required.

Accordingly, there is a need for a way to easily remove the cap from an ink supply container to enable the addition of more ink, thereby extending the useful life of the container. Thus, there is a need for an ink container opener that allows the consumer or user to remove the container cap without drilling holes into the cap.

One drawback of prior ink cartridge openers is the lack of a firm grip for the cartridge during a somewhat delicate procedure of separating ink top and bottom portions of the cartridge. Furthermore, another drawback of some of the openers is they require two or more pieces. While these multi-piece openers have been effective apparatus for opening cartridges, there is a need for an improved one-piece ink cartridge opener having enhanced gripping and stability features.

Furthermore, it is desirable to provide a one-piece cap removal tool which can be used with more than one type of ink container.

SUMMARY OF THE INVENTION

The present invention is directed to an ink cartridge opener for removing a cap from the ink supply cartridge to enable the addition of more ink, thereby extending the useful life of the cartridge. More particularly, the present invention includes a container opener which enables the consumer to remove the container cap from different types of ink containers using a single piece L-shaped opener. A first or holder member holds the cap of the container and a second member or base member provides for the container to be supported in cantilever fashion when force is applied to the container body. The user pushes down and exerts force onto an end of the container body spaced from the holder with the palm of his or her hand. This downward force then enables the cap to be disconnected or separated from the body. The opener enables a consumer to remove a cartridge cap using an opener design which securely holds the cap of the cartridge while the consumer pushes down on the cartridge body with the palm of his or her hand.

In accordance with another aspect of the invention, an ink container opener has a first portion and a second portion connected to the first portion. The first and second portions are approximately perpendicular to each other and each has an opening therein. The openings are each substantially rectangular in shape and of different size and/or edge profile for accommodating the caps of the different cartridges. The opening of the first portion can, for example, comprise a plurality of ridges extending along at least one side of the opening. The opening in the second portion can, for example, be smaller and have linear edges.

The fact that the opener can be used with more than one type of ink container by having several openings for receiving various ink container caps is of considerable advantage in that the opener requires less storage space than several openers for different size cartridges. The opener also requires less inventory to accommodate different ink container manufacturers.

Another advantage of the present invention is that the user's weight can be used in addition to hand and arm muscles to apply force to the container to open the container. In this respect, the opener can rest on the top of a work surface to absorb the applied force, thereby enabling operation with one hand. Alternatively, a consumer can apply force to the opener on the floor by the ball of a foot.

Of further advantage is that the cantilever support provides a mechanical advantage of approximately eight to one (8:1).

Another advantage of the invention is serrated edges of an opening to provide a more secure grip on the container cap.

Still other aspects and advantages of the invention will become apparent to those skilled in the art upon reading and understanding the following detailed description.

BRIEF DESCRIPTION OF THE DRAWINGS

The invention may take form in certain components and structures, a preferred embodiment of which is illustrated in the accompanying drawings wherein.

DETAILED DESCRIPTION OF PREFERRED EMBODIMENTS

Figure 1A:
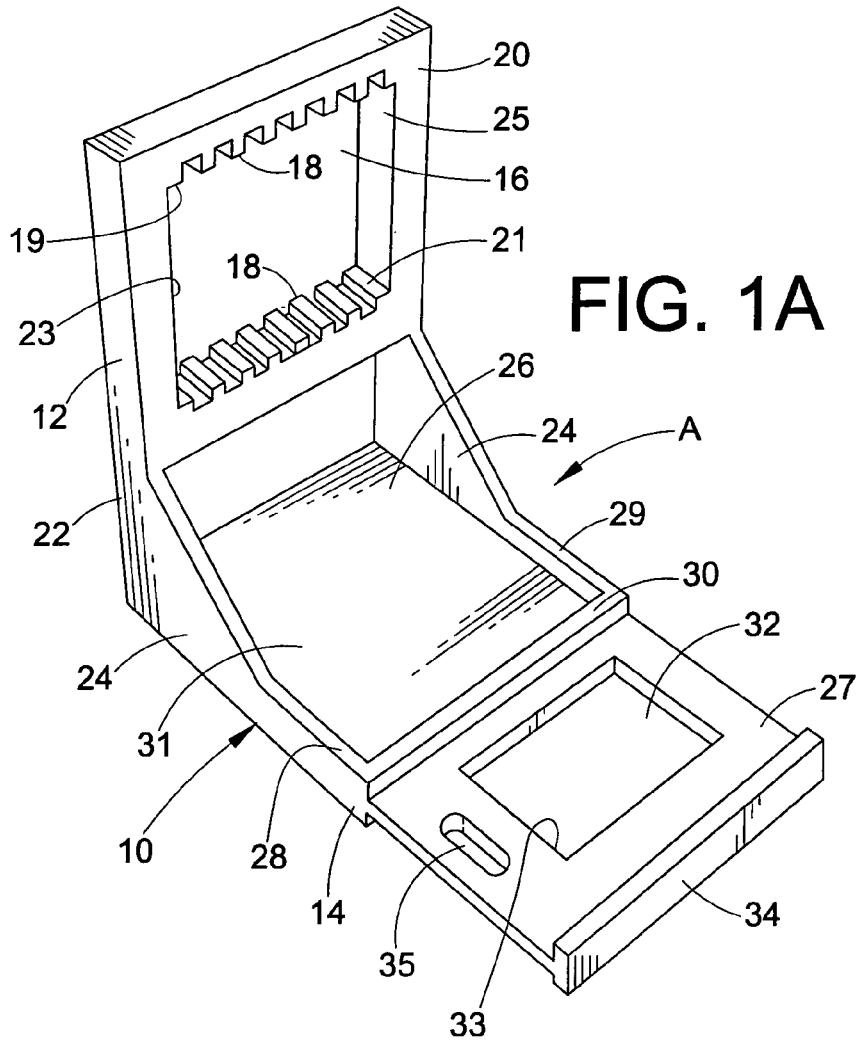
FIG. 1A is a perspective view of a one-piece ink container opener in accordance with a preferred embodiment of the present invention.
Figure 1B:
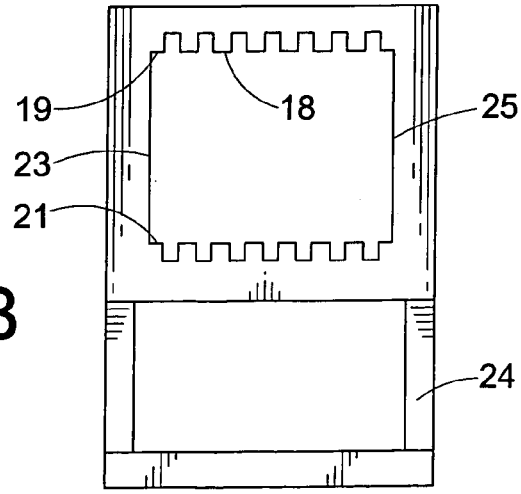
FIG. 1B is a front elevational view of the ink container opener of FIG. 1A.
Figure 2A:
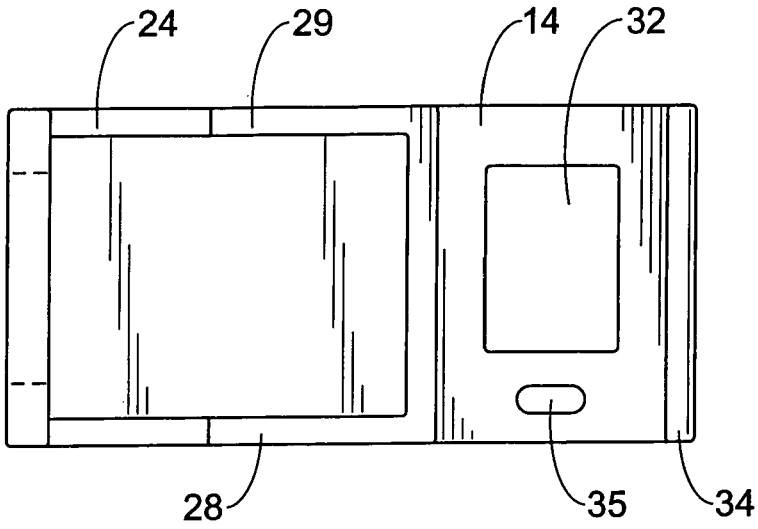
FIG. 2A is a top plan view of the ink container opener of FIG. 1.
Figure 2B:
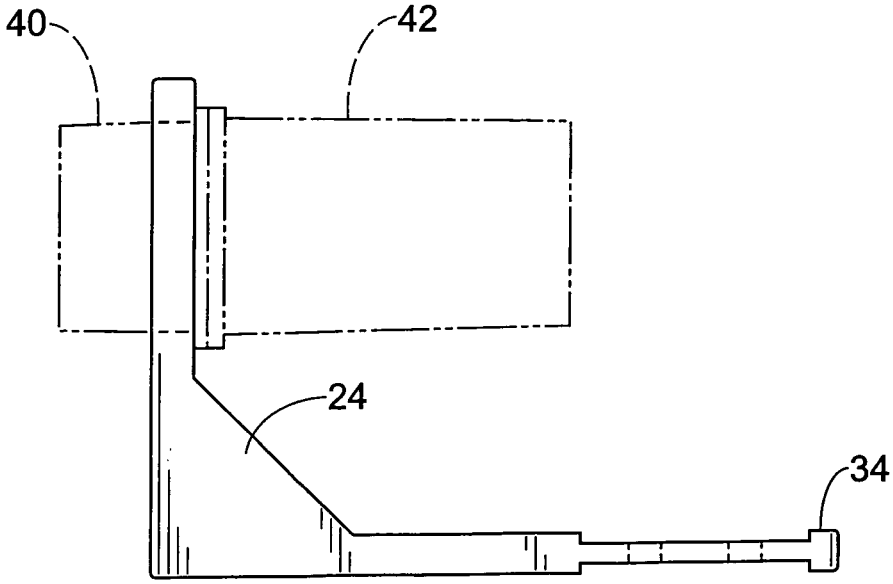
FIG. 2B is a side elevational view of the ink container opener of FIG. 1 showing an ink container installed in the opener in phantom.

Referring now to the drawings, wherein the showings are for purposes of illustrating the preferred embodiments of this invention only and not for purposes of limiting same, FIGS. 1A–1B and 2A–2B show an ink container opener A having a body 10 with a first member or arm 12 and a second member or arm 14 substantially perpendicular to each other. Each of the arms is substantially rectangular in shape and has flat surfaces. Arm 14 is shown to be of the same length or longer along a longitudinal axis than arm 12. However, arm 12 could be of the same length or longer than arm 14 in alternate embodiments. First arm or holder member 12 has an opening 16 adapted to receive a first portion or a cap of an associated ink container B (see FIGS. 2B and 3). Opening 16 is shown to be rectangular in configuration; however, other shapes are also contemplated by the invention. A plurality of ridges 18 extend along edges 19, 21 of opening 16. As can be seen in FIGS. 1A and 1B, the ridges are parallel to each other and are equally spaced apart. The ridges are also shown to be on edges which are opposite one another in the opening. However, ridges could also be provided on the opposing edges 23, 25. The ridges are shown to be shaped as rectangular bars; however, the ridges could be formed with sharp or serrated edges to provide a grip for engaging the outer surface of an ink cartridge cap member 40 (see FIG. 3).

The holder portion 12 and the second arm or base portion 14 are formed of a unitary construction from metal, or another suitable material, and are oriented approximately perpendicular to each other to form an L-shaped configuration. Reinforcement members 24 can be provided and interposed between the two members to provide additional strength and rigidity to the opener. As shown in the figures, reinforcement members 24 are generally triangular in shape and are parallel to and spaced apart from each other. The reinforcement members can be of a unitary construction with the base and holder members; however, they can also be welded to or otherwise secured to the two members.

Holder member 12 has a first end 20 and a second end 22 where the opening is positioned adjacent to the first end and the reinforcement members are positioned adjacent to the second end. Base member 14 has a first end 26 and a second end 27 where the reinforcement members are positioned adjacent the first end. Raised edges or ridges 28, 29, 30 are positioned on a surface 31 of base member 14 to provide additional strength and rigidity to the base member.

The base member 14 has an opening 32 adapted to receive a differently sized cap than opening 16. In the embodiment disclosed herein, opening 16 is adapted to receive a container cap from a container such as the Lexmark 12A1980 container, and opening 32 is adapted to receive a cap from a container such as the Lexmark 10N0026 container. As seen in FIG. 1A, opening 32 is also rectangular in configuration; however, other shapes are also contemplated by the invention. Opening 32 is shown to include a plurality of linear edges 33. Opening 32 is also shown to not include serrated edges; however, ridges or serrated edges could be provided in opening 32 if desired. A raised edge or rib 34 is provided on base 14 to add rigidity and strength to the base adjacent the opening 32. Opening 35 is provided to accommodate a portion of the cap of the Lexmark 10N0026 container.

Figure 3:
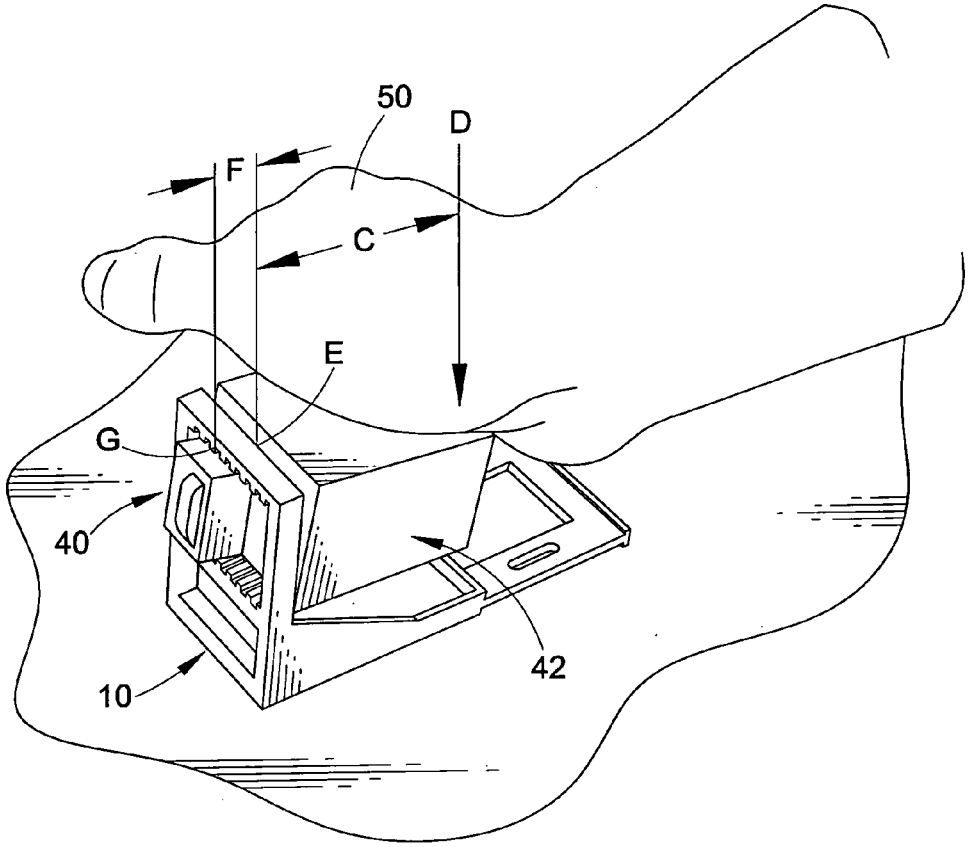
FIG. 3 is a perspective view of a user manually applying force to an ink container mounted in the ink container opener of FIG. 1; and, FIG. 4 is a perspective view of an ink container refill kit with the ink container opener of FIG. 1 mounted therein.

Referring now to FIG. 3, usage of the opener to separate a cap from an ink container will now be described. An ink container is positioned within the ink container opener by inserting cap 40 of the container within opening 16. A lip or ridge on the bottom edge of the container cap abuts the ridges 18 of opening 16. As will be appreciated from FIGS. 1 and 3, the container body is supported in cantilever fashion and a user's hand 50 then applies a downward force to the ink container thereby engaging the cap with the ridges 18 of opening 16 and applying force to the second portion or main body 42 of the container until the cap is disconnected from or separated from the container body. Member 14 acts as a support member that rests on a support surface such as a table or floor. The ink container is positioned between first and second ends 26, 27 of the support member 14 and is parallel to member 14. The support member 14 extends along a longitudinal axis of the container. The user's weight can be used in addition to hand and arm muscles. The opener can be placed on a work surface such as a desk or table to absorb the applied force of the user. This would enable a one-handed application of force to the ink container. Alternatively, for a user with weak hands or arms, or when the cap is too secure to achieve separation by hand, the opener can be placed on a floor surface and the ball or heel of the user's foot can apply the force directly to the ink container body. As seen in FIG. 3, the force to disconnect the cap from a container is applied in a downwardly direction by the palm of a user's hand. Alternatively, the force can be applied in a horizontal or other direction based on the orientation of the ink container opener. In this respect, for example, the opener could be hung on a wall with member 12 extending horizontally, whereby the container would extend vertically when cap 40 is introduced into opening 16.

The opener provides a mechanical force advantage of approximately eight to one (8:1). That is, referring to FIG. 3, the distance C from the force application point D in a longitudinal direction to the cap or body joint E is approximately eight times greater than the distance F from the cap support point G to the cap body joint E.

If opening 32 of the base 14 is to be used to separate a cap from a differently sized ink container (such as the Lexmark 10N0026 cartridge), the steps would be essentially as described above for using opening 16 to open a container except the holder member would be placed on a support surface and a cap would be inserted into opening 32.

Figure 4:
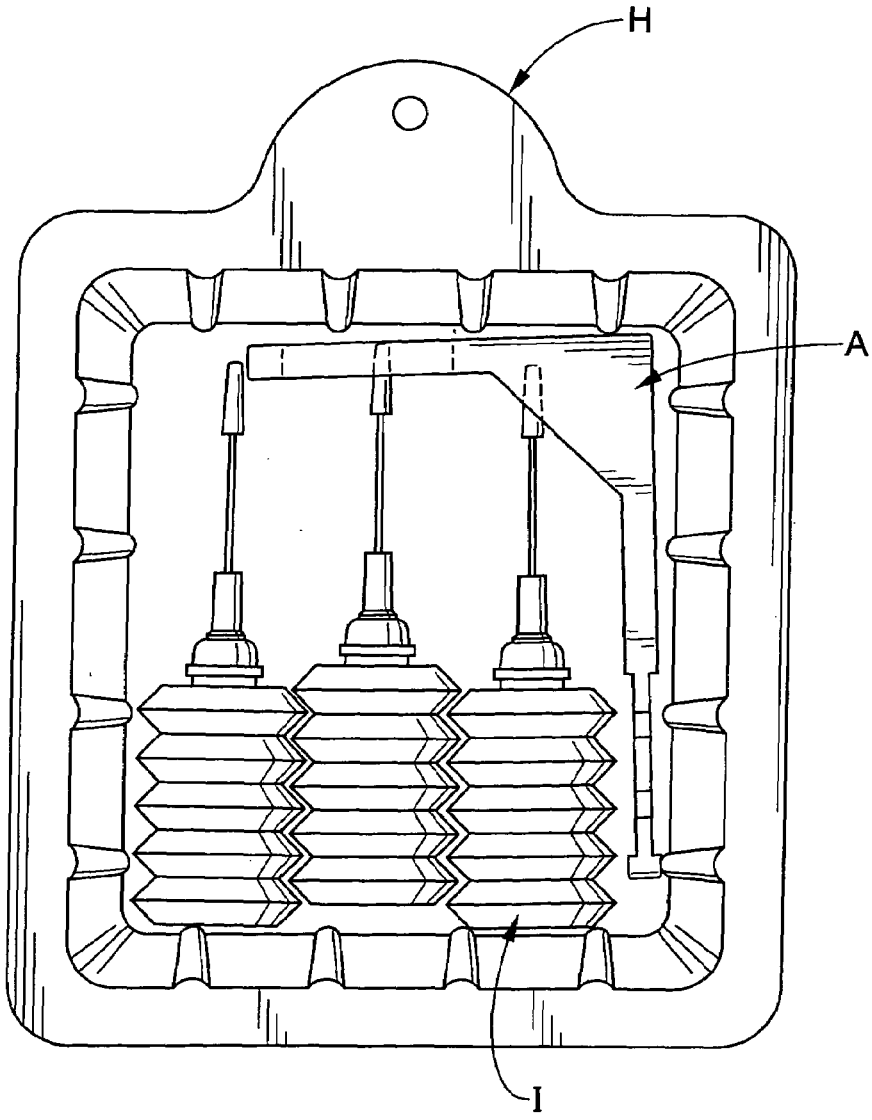

The base member is shown to be longer in a longitudinal direction than the holder member; however, other dimensions for the members can also be used. As previously mentioned, the opener is formed with a substantial L-shaped configuration. The L-shape of the opener allows for space efficiency within a refill kit container. That is, the opener can be placed into a corner of a refill kit container H as seen in FIG. 4 along with a plurality of ink supply bottles I and requires only a small increase in the refill kit container volume.

The invention has been described with reference to a preferred embodiment. Obviously, alterations and modifications will occur to others upon a reading and understanding of this specification. The invention is intended to include all such modifications and alterations insofar as they come within the scope of the appended claims or the equivalents thereof.

Having thus described the invention, we claim:

1. A method of opening an ink container of the type having first and second connected container portions, said method using a one-piece ink container opener having a first and second container holder member; and each of said holder members having an opening for receiving a cap of said ink container, said method comprising:

supporting a cap of said container within one of said openings of said first and second holder members;

placing the other of said holder members on a work surface;

applying lateral force to a body of the container until said container first portion is disconnected from said container second portion.

2. An ink container opener comprising:

a first portion which is adapted to remove a cap of an ink container; and, a second portion connected to said first portion, wherein said first and second portions are approximately perpendicular to each other; said first portion and said second portion each comprising an opening, wherein said openings of said first and second portions are each adapted to receive said cap of said ink container, wherein said opening of said first portion comprises a plurality of ridges extending along at least one side of said opening.

3. The ink container opening of claim 2, wherein said ridges are substantially rectangular in shape and are equally spaced apart from one another.

4. The ink container opener of claim 2, further comprising a plurality of reinforcement members between said first and second portions.

5. The ink container opener of claim 4, wherein said reinforcement members are spaced apart and parallel to one another.

6. The ink container opener of claim 5, wherein said reinforcement members are integral with said first portion and said second portion.

7. The ink container opener of claim 6, wherein said reinforcement members are substantially triangular in shape.

8. The ink container opener of claim 4, wherein said reinforcement members are of unitary construction with said first and second portions.

9. The ink container opener of claim 2, wherein said openings are each substantially rectangular in shape.

10. The ink container opener of claim 2, wherein said second portion is longer than said first portion along a longitudinal axis of said first and second portions.

11. The ink container opener of claim 2, wherein said first portion and said second portion are of unitary construction.

12. The ink container opener of claim 2, wherein said opener is substantially L-shaped.

13. An ink container opener comprising:

a container holder member adapted to hold a cap of an ink container;

a support member adapted to be placed on a work surface, wherein said holder member and support member each includes an opening for receiving and holding said cap of an ink container: and said holder member and said support member are formed of a unitary construction and are approximately perpendicular to one another, wherein said opening of said holder member comprises a plurality of teeth along an inner edge thereof.

14. The ink container opener of claim 13, wherein said ink container opener further comprises a plurality of reinforcement members interconnecting said holder member and said support member.

15. The ink container opener of claim 13, wherein said support member comprises a support surface for supporting said opener when force is applied to said holder member.

16. The ink container opener of claim 13, wherein said opening of said holder comprises a plurality of ridges formed on internal surfaces thereof.

17. An opener for removing a cap from an ink container body, comprising:

means for supporting a cap of said ink container, comprising:

a first portion connected to a second portion and extending at an angle thereto, said first and second portions each including an opening for receiving said container cap and spacing the container body from the other of said first and second portions, wherein at least one of said openings includes ridges substantially rectangular in shape and equally spaced apart from one another.

18. The opener of claim 17, wherein each of said openings is substantially rectangular in shape.

19. The opener of claim 17, wherein at least one of said openings has a plurality of linear edges.

20. The opener of claim 17, further including a plurality of reinforcement members between said first and second portions.

21. The opener of claim 17, wherein said first portion and said second portion are perpendicular to one another.

22. The opener of claim 17, wherein said openings of first portion and said second portion are of different sizes.

* * * * *